United States Patent [19]

Kan et al.

[11] Patent Number: 4,492,371

[45] Date of Patent: Jan. 8, 1985

[54] FEEDING DEVICE

[75] Inventors: Yasuhito Kan, Urawa; Koichi Miyamoto, Tokyo, both of Japan

[73] Assignee: Canon Kabushiki Kaisha, Tokyo, Japan

[21] Appl. No.: 234,601

[22] Filed: Feb. 17, 1981

[30] Foreign Application Priority Data

| | | | |
|---|---|---|---|
| Feb. 22, 1980 | [JP] | Japan | 55-21345 |
| Oct. 2, 1980 | [JP] | Japan | 55-138003 |
| Oct. 2, 1980 | [JP] | Japan | 55-138001 |

[51] Int. Cl.[3] ..... B65H 3/32

[52] U.S. Cl. ..... 271/21; 271/170

[58] Field of Search ..... 271/19-25, 271/16, 17, 169, 170

[56] References Cited

U.S. PATENT DOCUMENTS

| | | | |
|---|---|---|---|
| 1,028,091 | 5/1912 | Matthews | 271/21 |
| 3,110,489 | 11/1963 | Zahradnik | 271/22 |
| 3,350,089 | 10/1967 | Niccoli | 271/21 X |
| 3,476,381 | 11/1969 | Carlson | 271/21 UX |
| 3,664,663 | 5/1972 | McPherson | 271/21 X |
| 3,893,663 | 7/1975 | Sanchez | 271/21 |

FOREIGN PATENT DOCUMENTS

| | | | |
|---|---|---|---|
| 57762 | 5/1979 | Japan | 271/170 |
| 11098 | 3/1980 | Japan . | |
| 20601 | of 1903 | United Kingdom | 271/24 |

*Primary Examiner*—Richard A. Schacher

*Attorney, Agent, or Firm*—Fitzpatrick, Cella, Harper & Scinto

[57] ABSTRACT

A device for feeding, sheet by sheet, a plurality of stacked sheets of paper cut in a predetermined size into an image forming apparatus such as, for example, a reproduction apparatus, a printing machine, and so forth, which is constructed with a stacking table to receive thereon a plurality of sheets of paper cut in size, pawls for separating the stacked sheets cut in size and mounted on the stacking table, feeding device to feed the cut sheet stacked on the stacking table, and a warp regulating member provided on a fixed member to regulate warping of the cut sheet by contacting thereto when such warping is formed in the sheet between the feeding device and the separation pawls.

17 Claims, 21 Drawing Figures

FIG. 9A
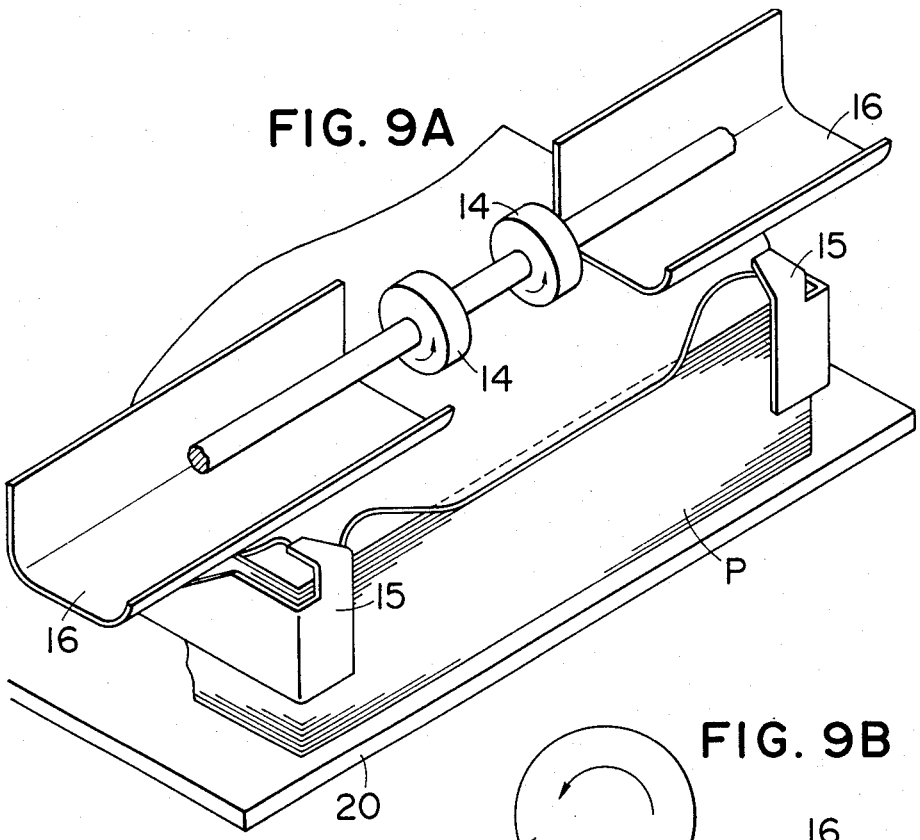
FIG. 9B
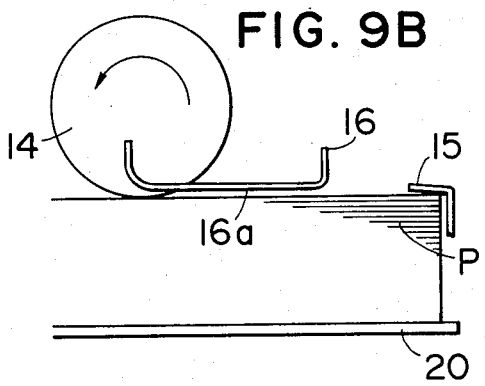
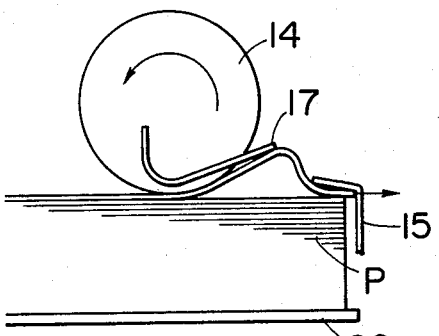
FIG. 10
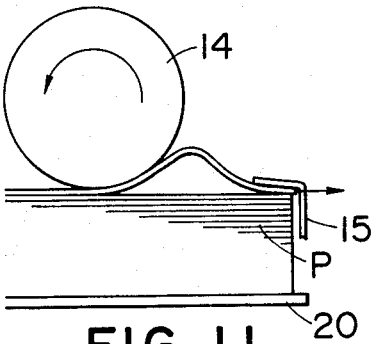
FIG. 11

FEEDING DEVICE

BACKGROUND OF THE INVENTION

1. Field of the Invention

This invention relates to a feeding device to feed, sheet by sheet, a plurality of stacked sheets of paper cut in a predetermined size into an image forming apparatus such as, for example, a reproduction apparatus, printing machine, and so forth. More particularly, it is concerned with a paper feeding device to feed, sheet by sheet, a plurality of stacked sheets of paper cut in a predetermined size by use of pawls serving to separate such stacked sheets on a stacking table.

2. Description of the Prior Art

As a device for separating and feeding, sheet by sheet, a plurality of sheets of paper cut in size and stacked on a stacking table, there has so far been widely used a device of such a construction, wherein a set of separation pawls are urged against the forward end corners of the stack of cut sheets, and feeding rollers are press-contacted on the surface of the top sheet, while they are being rotated, thereby forming warp in the top sheet between the separation pawls and the feeding rollers, and causing the top sheet alone to be released from the separation pawls.

Such conventional feeding device, however, has various problem to be mentioned hereinbelow in reference to Figures of drawing accompanied by this application.

Referring to FIGS. 1 and 2, respectively showing a side elevational view and a top plan view of the conventional feeding device, a pile of sheets of paper P cut in a predetermined size are placed on a stacking table 1, the topmost sheet press-contacting to feeding rollers 3, 3*a* by force of a spring 4. By rotation of the feeding rollers 3, 3*a* in the direction of an arrow in the drawing, the topmost sheet is advanced by frictional force with the feeding rollers 3, 3*a*. At this instant, warps A, B are formed in the top sheet between its forward end corners and the feeding rollers 3, 3*a* due to separation pawls 5, 5*a*. The warping causes the sheet to be separated from other stacked sheets, released from the separation pawls due to restoring force which tends to reinstate the paper to its original flat state from its warped condition, and fed out. By the way, a reference numeral 6 designates a pivotal point for oscillation of the stacking table 1.

FIG. 3 illustrates a state of the warp B which has been formed under the optimum condition of a distance from the feeding roller 3*a* to the separation pawl 5*a*, wherein the topmost sheet is in a state of being slightly pushed forward, and the warped corner B is about to be released from the separation pawl 5*a* due to the restoring force of the sheet. Here, when cut sheets having the same paper width are to be fed by the same feeding device, the feed rollers can be disposed at an equal and optimum distance from the left and right separation pawls, as shown in FIG. 2. However, in case the cut sheets in various sizes are required to be fed into reproduction apparatus, etc. by the same feeding device, it is difficult to fixedly maintain the feed rollers at such equal and optimum distance from the left and right separation pawls. For instance, when the feed rollers 3, 3*a* are disposed at the optimum positions suited for a paper width $L_0$ as in FIG. 4, such positioning will not do for a sheet having a width $L_1$, because, in this case, the feed roller 3*a* is on one edge of the sheet, on account of which no warp is formed at this position. This would cause an inbalanced condition in the sheet feeding at both left and right sides. Also, with a sheet having a width $L_2$, since the feed roller 3*a* is too distant from the separation pawl 5*a*, the warp B becomes excessively large to reduce the restoring force of the sheet, whereby it becomes difficult for the sheet to be released from the separation pawl 5*a*. This would also cause an inbalanced condition in the sheet feeding at both left and right sides.

SUMMARY OF THE INVENTION

It is therefore an object of the present invention to provide a feeding device capable of feeding cut sheets of paper in various widths at its favorable separating and feeding performances without requiring any complicated mechanisms and devices whatsoever.

Broadly speaking, the present invention is intended to provide a feeding device having a warp regulating member mounted on the sheet stacking table or the main body of the image forming apparatus, and to suppress the warping when it occurs in the cut sheet between the feeding means and the separation pawls, thereby making it possible to feed the cut sheet in a stable manner.

BRIEF DESCRIPTION OF THE DRAWING

In the drawing

FIGS. 8B, 9B, 10 and 11 are respectively side views of the feeding device, in which preferred exbodiments of the present invention are adopted;

FIG. 8A is a perspective view of the feeding device shown in FIG. 8B;

FIG. 9A is a perspective view of the feeding device shown in FIG. 9B;

DESCRIPTION OF PREFERRED EMBODIMENTS

In the following, the feeding device according to the present invention will be described in full detail in reference to the accompanying drawing.

Figure 1:
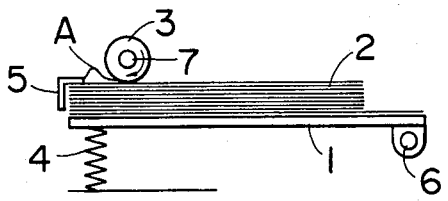
FIG. 1 PRIOR ART
FIG. 1 is a side elevational view of a conventional feeding device.
Figure 2:
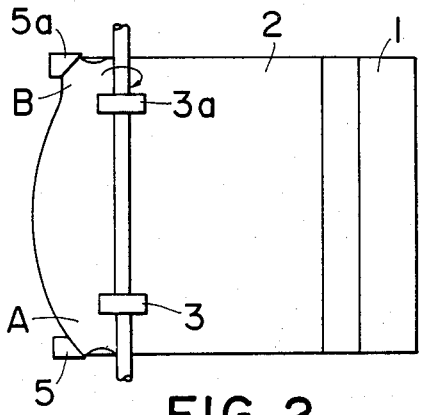
FIG. 2 PRIOR ART
FIG. 2 is a top plan view of the conventional feeding device in FIG. 1.
Figure 3:
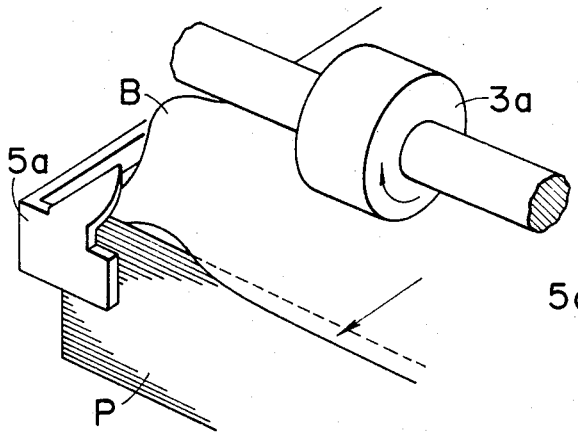
FIG. 3 PRIOR ART
FIG. 3 is a perspective view of the main part of the conventional feeding device.
Figure 4:
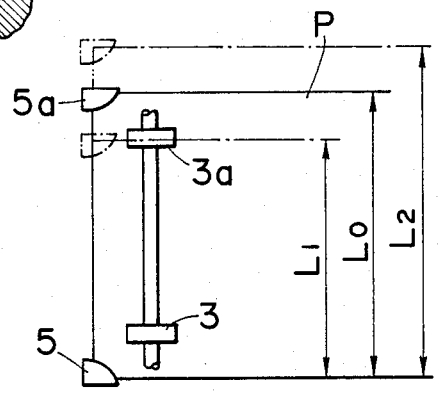
FIG. 4 PRIOR ART
FIG. 4 is an explanatory diagram showing a state of feeding cut sheets in various sizes by the conventional feeding device.
Figure 5:
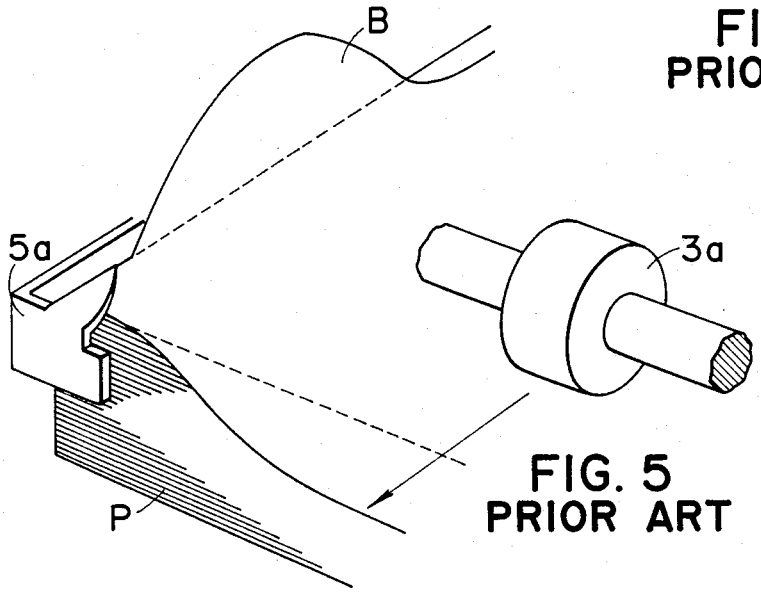
FIG. 5 PRIOR ART
FIG. 5 is a perspective view of the main part of the conventional feeding device.
Figure 6B:
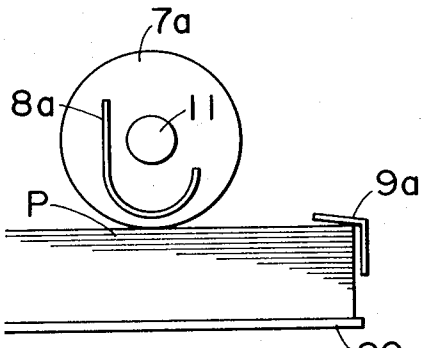
FIG. 6B is a side view of the feeding device shown in FIG. 6A.
Figure 6A:
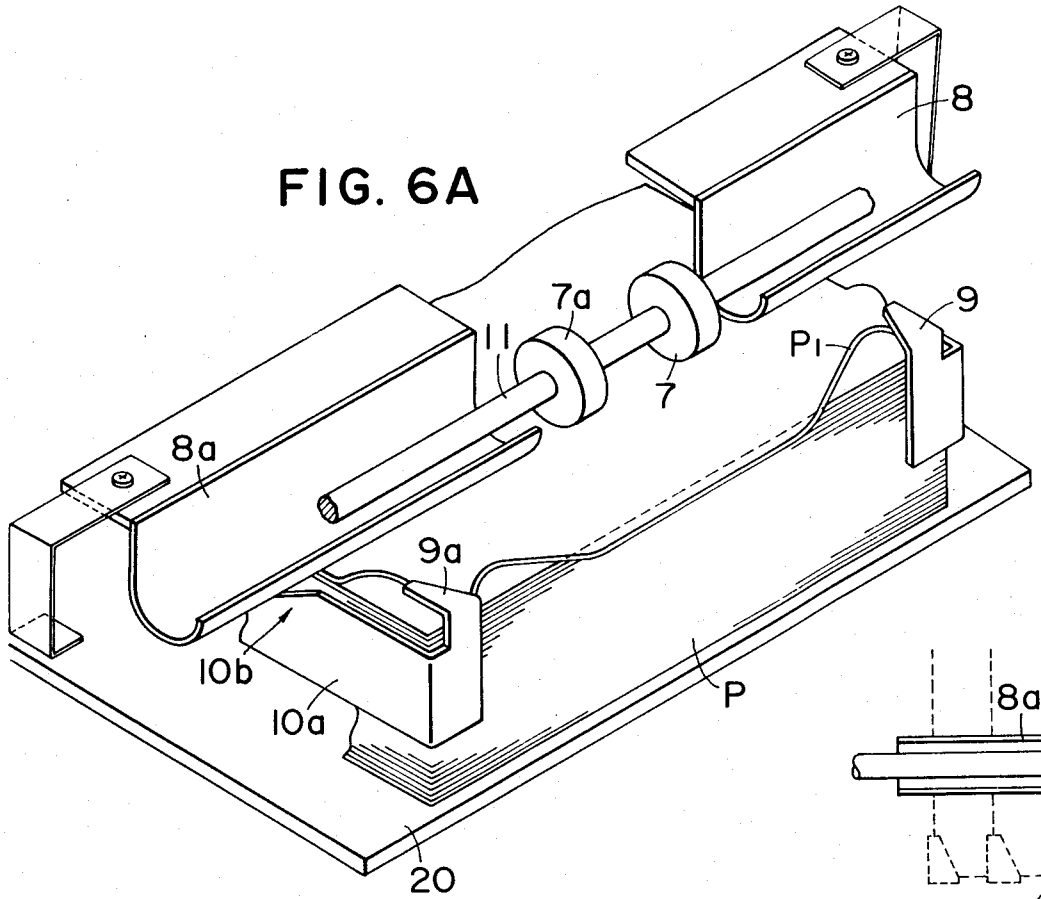
FIG. 6A is a perspective view of a feeding device, in which one preferred embodiment of the present invention is adopted.

Referring to FIGS. 6A and 6B showing one preferred embodiment of the present invention, reference numerals 7, 7*a* designate feeding rollers which forward cut sheet from a stack. The feed rollers are disposed at a distance narrower than the minimum width of the cut sheet to be fed, and press-contact the top surface of the stacked cut sheets under a predetermined pressure. The feed rollers 7, 7*a* are provided on the side of the main body of the reproduction apparatus, and rotate by driving force of a drive source (not shown in the drawing). They may be either fixed at, or move to and from a predetermined feeding position. Numerals 8, 8*a* refer to warp regulating plates mounted on, for example, a sheet stacking table 20. The front end of the warp regulating plates 8, 8*a* is in a substantially arcuate shape, and is positioned closer to the top surface of the stacked cut sheet in a non-contact state. Further, the warp regulating plates 8, 8*a* are disposed at their respective predetermined positions away from separation pawls 9, 9*a* by a certain definite distance, and extend in the breadthwise direction of the cut sheet from the vicinity of the feed rollers 7, 7*a* and in parallel with an axis 11 thereof. In other words, the warp regulating plates 8, 8*a* are extendingly provided in the direction perpendicular to the sheet feeding direction. The separation pawls 9, 9*a* separate the top sheet from the stack as mentioned in the foregoing, and separation pawl arms 10, 10*a* oscillatably support the pawls 9, 9*a* have notches 10*b* at their one part near the warp regulating plates 8, 8*a* so as not to interfere therewith.

Figure 7:
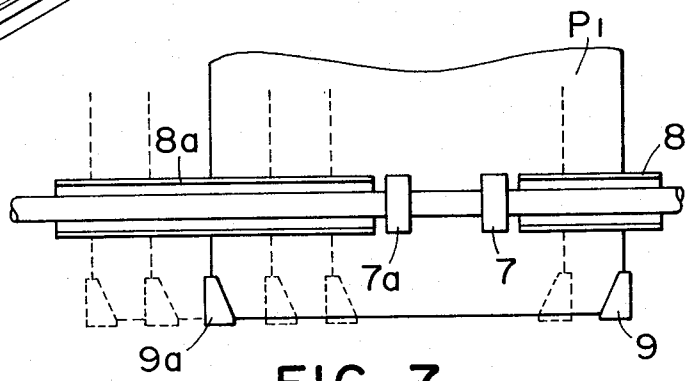
FIG. 7 is a plan view showing the main part of the feeding device shown in FIGS. 6A and 6B.

When the feed rollers 7, 7*a* start rotation by, for example, a copy signal, and send out the topmost sheet $P_1$ from the stack of cut sheets, the sheet $P_1$ as sent out is temporarily hindered in its travelling at its forward corners by the separation pawls 9, 9*a* to form warps at both corners of the forward end. At this instant, since, according to the embodiment of the present invention, the warp regulating plates 8, 8*a* are provided, and the warps formed in the cut sheet $P_1$ contact the regulating plates 8, 8*a* to be suppressed in their growth, so they do not become too large, and are therefore formed only between the warp regulating plates 8, 8*a* and the separation pawls 9, 9*a*. In other words, an appropriate warping can be formed in the vicinity of the separation pawls 9, 9*a*. Therefore, the conveying force to be transmitted to the cut sheet $P_1$ by the feed rollers 7, 7*a* is in no way absorbed by growth of the warping, but it can be transmitted to the forward end corners of the cut sheet $P_1$. As the result of this, the cut sheet $P_1$ can be released without failure from the separation pawls 9, 9*a* owing to the appropriate warping formed in the vicinity of the separation pawls by the conveying force as well as tenacity of the cut sheet per se, whereby the topmost cut sheet $P_1$ is separated from the stack of cut sheets P, and fed into the image reproduction apparatus. Also, as mentioned in the foregoing, the warp regulating plates 8, 8*a* are extendingly disposed in parallel with the axis 11 of the feed rollers 7, 7*a* from the neighborhood thereof. On account of this, the relationship between the separation pawls 9, 9*a* and the warp regulating plates 8, 8*a* to the cut sheet remains unchanged, even when the separation pawls 9, 9*a* take different positions due to varying sizes of the cut sheets for use as shown in FIG. 7, hence no change takes place in the separating and feeding performances of the feeding device, and constantly stable performances can be attained. According to the experiments done by the present inventors, the distance between the warp regulating plates 8, 8*a* and the separation pawls 9, 9*a* should optimumly range from 20 to 40 mm.

In the case of this embodiment, the warp regulating plates 8, 8*a* do not contact the cut sheet until the topmost sheet is forwarded by the feed rollers 7, 7*a* and forms warping at the forward end corners thereof to even a slight extent by the separation pawls 9, 9*a*. That is to say, the warp regulating plates 8, 8*a* are at least in a non-contact state at the commencement of the feeding, i.e., from rotation of the feed rollers up to collision of the cut sheet against the separation pawls 9, 9*a*. When the cut sheet hits the separation pawls, the topmost cut sheet continues to be sent out by the conveying force of the feed rollers 7, 7*a*, and the forward end corners of the cut sheet remain at the separation pawls 9, 9*a* to thereby create the warping at the forward end corners. However, since the warp regulating plates 8, 8*a* are in the non-contact state until the topmost sheet $P_1$ becomes warped, the conveying force from the feed rollers 7, 7*a* can sufficiently reach the forward end corners of the cut sheet in the vicinity of the separation pawls 9, 9*a*. Further, in this embodiment, since the warp regulating plates 8, 8*a* are disposed in parallel with the shaft 11, they directly contact the top sheet, and, moreover, since the distance between the warp regulating plates 8, 8*a* and the feed rollers 7, 7*a* is equal in both left and right sides, the cut sheet does not move obliquely, but it is forwarded in the accurate feeding direction. According to the experiments done by the present inventors, a space gap between the warp regulating plates 8, 8*a* and the topmost sheet should preferably be from 1 to 10 mm or so.

Figures 8A, 8B:
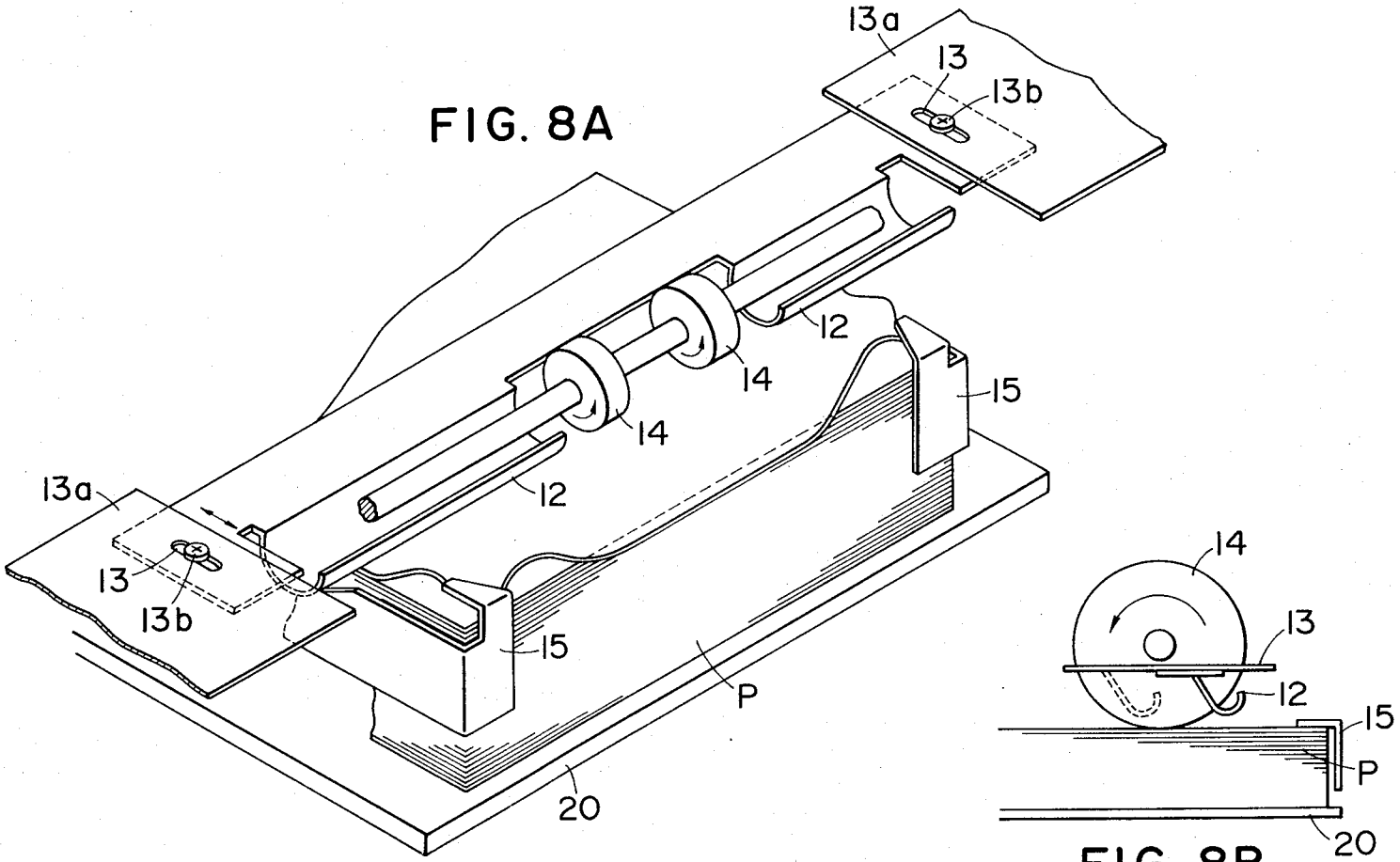

In the following, other embodiments of the feeding device according to the present invention will be described in reference to FIGS. 8A to 11, in which FIGS. 8A and 8B show the warp regulating plate 12 in a substantially hook shape in its cross-section, which is movably mounted on the main body of the reproduction apparatus. In this embodiment, the rear end of the warp regulating plate 12 is slidably fitted by a threaded screw 13*b* along a slot 13 in a fixed plate 13*a* provided on the main body of the reproduction apparatus, etc., By this construction, the warp regulating plate 12 slides along the slot 13, and the position of the warp regulating plate 12 closest to the top sheet can be adjusted, and the warping in the sheet can be regulated at its optimum position. Incidentally, the warp regulating plate 12 can be fixed in a simple manner at the adjusted position by the threaded screw 13*b*, etc. and its setting angle can also be adjusted.

That is to say, since the warping to be formed at the forward end of the sheet varies depending on factors such as shape of the separation pawls, sheet feeding speed, variations in distance from the forward end of the sheet to its position where it contacts the feed rollers, and so on, it is not so easy to form the most appropriate warping without failure to separate and feed the topmost sheet one by one. Particularly, since the positions of the feed rollers are mostly determined from the construction of the main body, which is difficult to change, and the feeding speed cannot also be changed from the standpoint of the machine performance.

Therefore, according to this embodiment, since the fitting position of the warp regulating plate 12 can be freely adjusted, mutual relationship between the contact position of the feed roller 14 and the sheet, and the position of the warp regulating plate 12 closest to the sheet can be arbitrarily set with a view to forming the most appropriate warping in the stacked sheets so as to enable them to be separated sheet by sheet. For this purpose, the warp regulating plate 12 can be disposed at the optimum position and angle, whereby separation and feeding of the sheet can be easily performed with constantly good condition. Further, at the time of loading the stack of cut sheets, the warp regulating plate can escape to a position where it does not interfere with the operation, which serves for protecting the warp regulating plate and improving in the operability of the device as well.

According to this embodiment, the warp regulating plate engages its rear end with the slot 13 to be slidable, and can be fixed at its adjusted position with the threaded screw 13*b*, hence it can be simply replaced by another warp regulating plate in different configuration.

Incidentally, according to the experiments done by the present inventors, it has been found out that the optimum separating and feeding performances can be exhibited when the feed rollers are lagged in the forward end direction by 3 to 5 mm from a position where the feed rollers contact the sheet.

Referring now to FIGS. 9A and 9B, still another embodiment of the feeding device according to the present invention will be explained. FIGS. 9A and 9B illustrate a construction, wherein the feed rollers 14 and the separation pawls 15 are widely spaced apart for convenience in constructing the main body. In this embodiment, the warp regulating plates 16, 16 are in the form of an angled "U", and are so disposed that the flat bottom surface 16*a* thereof may be substantially parallel with the surface of the stacked sheet. On account of this, the warping in the sheet can be formed within a predetermined range from the separation pawls 15 by adjusting the length of the flat bottom portion 16*a*, whereby satisfactory separating and feeding performances can be attained.

FIG. 10 illustrates another embodiment of the present invention, wherein the warp regulating plate 17 is obliquely bent upward in the sheet forwarding direction so as to enable the warping formed in the sheet to be readily pushed forward. By this construction of the warp regulating plate 17, the restoring force of the sheet due to its tenacity tends to be easily directed forwardly, and the sheet can be disengaged from the separation pawls with less warping therein as compared with the warping formed in the sheet by the feed rollers 14, as illustrated in FIG. 11. This construction of the warp regulating plate 17 is therefore particularly effective in case the space above the stacked sheets (the space where the warping is formed) is relatively narrow.

Incidentally, the illustrated embodiments in FIGS. 8A through 10 provide the warp regulating plate, which protrudes beyond the outer periphery of the feed rollers 14, which also serves to prevent the sheet from being wound around the feed follers 14 to cause disorder in the machine operation.

Furthermore, the warp regulating plate may be produced with any material such as spring material, ferrous material, or other shaped materials. When its surface adjacent to the top sheet in the stack is smooth, more favorable separating and feeding performances can be exhibited. In addition, this warp regulating plate is not limited to being provided on the main body of the reproduction apparatus, but it may be mounted on the stacking table. Moreover, the sheet stacking table may be either fixed on the main body of the reproduction apparatus, or the so-called cassette type which is loadable on and unloadable from the main body of the reproduction apparatus.

A further embodiment of the present invention will be explained hereinbelow in reference to FIGS. 12A and 12B. In this embodiment, a distance between a portion of the warp regulating member contacting the cut sheet (or the closest portion to the cut sheet) and the surface of the topmost cut sheet is so made that it is relatively longer at the side away from the feeding means than at the side near the feeding means.

In the drawing, reference numerals 21, 21*a* designate feed rollers to forward a cut sheet P. The feed rollers are disposed at positions narrower than the minimum sheet width to be fed, and are press-contacted to the upper surface $P_1$ of the topmost sheet in the stack under a predetermined pressure. Incidentally, the feed rollers 21, 21*a* are provided at the main body side of the reproduction apparatus. They may either be fixed at a predetermined feeding position (in this case, the cut sheet is movable to the predetermined feeding position by a push-up means such as, for example, a spring, etc.) or be movable to the predetermined feeding position by a well known means.

Numerals 22, 22*a* refer to warp regulating plates for the cut sheet, each being provided on a fixed plate 25 at the main body side of the reproduction apparatus. The surface of the warp regulating plate facing the upper surface of the stacked sheet is substantially arcuate, and is maintained in a non-contact state thereto during non-feeding of the sheet. Further, the warp regulating plates 22, 22*a* are disposed at their predetermined positions away by a certain definite distance (in the feeding direction) from the separation pawls 23, 24 which are oscillatably provided at the forward end corners in the feeding direction of the stacked sheets, and extend in the breadthwise direction of the sheet from the neighborhood of the feed rollers 21, 21*a* along a roller shaft 26 thereof. That is to say, the warp regulating plates 21, 21*a* are provided to extend in the direction perpendicular to the sheet feeding direction. Moreover, these warp regulating plate 21, 21*a* gradually increase their distance from the top surface $P_1$ of the sheet as they extend in the breadthwise direction of the sheet from the neighborhood of the feed rollers 21, 21*a*. In other words, the warp regulating plates are so provided that they are upwardly inclined as they extend sidewise (in the direction perpendicular to the sheet feeding direction), whereby the space interval from the top surface $P_1$ of the sheet gradually increases. Thus, when the distance between the warp regulating plates 22, 22*a* and the upper surface $P_1$ of the cut sheet is made small at the side near the feed rollers 21, 21*a*, and large at the side away therefrom (i.e. the side edge of the cut sheet) ($\alpha_1 < \alpha_2$ in the drawing), the warp formation becomes easy, and, at the same time, the warping does not become excessively large, whereby warping in an appropriate size can be formed in the vicinity of the separation pawls 23, 24. In the following, the reason for this will be explained.

At the contact portion between the feed rollers 21, 21*a* and the top surface $P_1$ of the cut sheet in stack, the sheet P is urged by the feed rollers, while, at the other portion, there exists noticeable raise due to piling of a multitude of sheets in the stack. Therefore, the top surface of the sheet in the stack of a multitude of sheets is not perfectly flat, but, as shown by a dot-and-dash line a in FIG. 12A, both end parts as well as an intermediate portion between the feed rollers 21, 21*a* of the stacked sheets rise upward or bulge out. By providing the warp regulating plates 22, 22*a* as in this embodiment, the warping to be formed, when the topmost sheet in the stack is sent out by rotation of the feed rollers 21, 21*a*, and the forward end corners thereof collide against the separation pawls 23, 24 to temporarily hinder its further forwarding, can continue its growth without being interfered by this warp regulating plates 22, 22*a* until it reaches a certain determined size, i.e., the warp formation becomes easy. Moreover, by providing the warp regulating plates 22, 22*a* as such, the size of the warping can be controlled in conformity to the shape of the warping without impairing the same. As the consequence, the warping in an appropriate shape and size can be formed in the vicinity of the separation pawls 23, 24. Since the warp regulating plates 22, 22*a* can be maintained in the perfectly non-contact state until the topmost sheet which has been sent out by rotation of the feed rollers 21, 21*a* is temporarily hindered in its forwarding movement at its forward end corners by the abovementioned separation pawls 23, 24 to thereby form the warping to even a slight degree, the conveying force of the feed rollers 21, 21*a* can be sufficiently transmitted to the forward end corners of the cut sheet in the vicinity of the separation pawls 23, 24, whereby feeding of the cut sheet can be effected without failure.

Furthermore, by providing the warp regulating plates 22, 22*a* as in this embodiment, good warping can be formed in the cut sheet of varying sizes.

In the following, the reasons for the abovementioned fact will now be explained in detail.

Figure 12A:
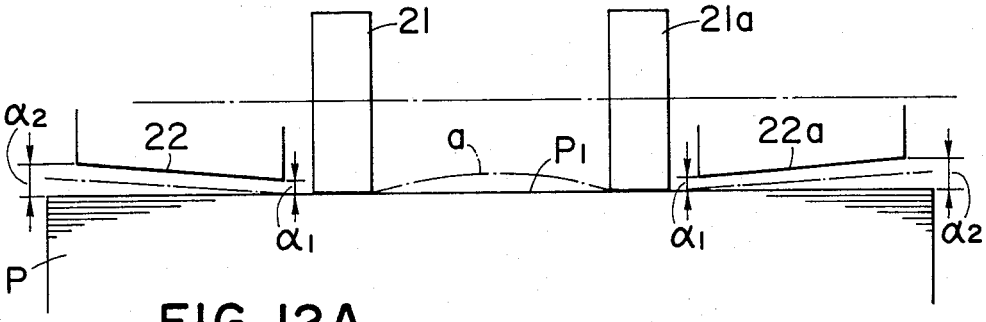
FIG. 12A is a side elevational view of another embodiment of the feeding device according to the present invention.
Figure 13:
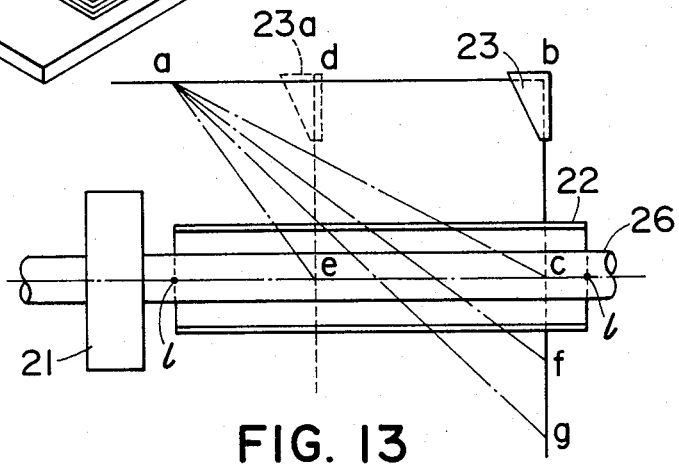
FIG. 13 is an explanatory diagram of warp formation.

In FIG. 13, it is assumed that the ridge portion of the warp regulating plates 22, 22*a* closest to the surface of the cut sheet is denoted by l—l, and that the warp regulating plates are provided in parallel with the stacked cut sheets ($\alpha_1=\alpha_2$ in FIG. 12A). The warping formed in the vicinity of the separation pawl 23, in the case of feeding a cut sheet having broad width, is represented roughly by a triangle a-b-c. When the cut sheet having a narrow width is to be fed, the warping formed in the vicinity of the separation pawl 23*a* is represented roughly by a triangle a-d-e. Here, in order that the cut sheet may be released and fed from the separation pawls without failure, making much use of its tenacity, the warping to be formed in the vicinity of the separation pawl should desirably be a triangle having a long length in the sheet feeding direction (forwarding direction). i.e., a triangle a-d-e.

Figure 12B:
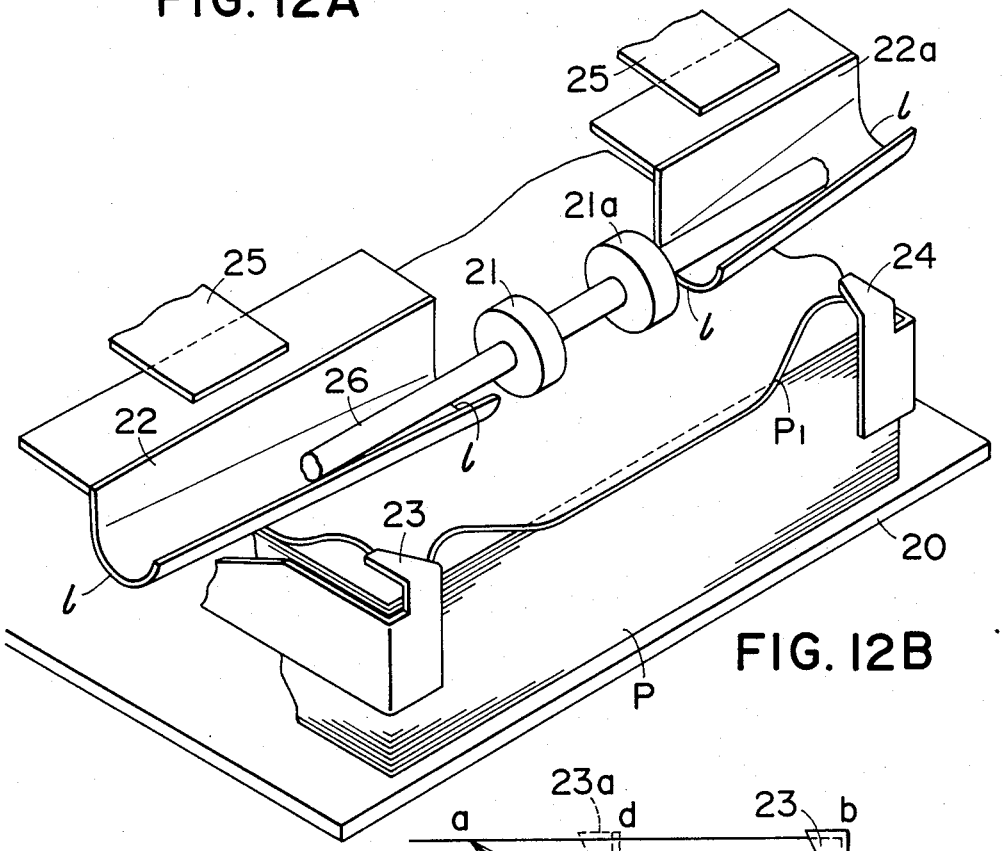
FIG. 12B is a perspective view of the feeding device shown in FIG. 12A at its feeding operation.

Therefore, as shown in FIGS. 12A and 12B as in this embodiment, when the warp regulating plates 22, 22*a* are disposed with a gradual upward inclination ($\alpha_1<\alpha_2$) as they extend in the breadthwise directions of the sheet, the warping can be made larger at the side far from the feed rollers at the time of feeding the sheet having broad width, as the result of which the warping to be formed in the vicinity of the separation pawls is as shown in FIG. 13, i.e., a triangle a-b-f. Further, when $\alpha_2$ is made greater, the warping will gradually grow longer as represented by a triangle a-b-g. Accordingly, by establishing a gap between the warp regulating plates 22, 22*a* and the top surface $P_1$ of the sheet to be gradually larger as the regulating plates extend from their one end near the feed rollers 21,21*a* to the other end of the outer edge of the sheet, a long, favorable warping can be formed in the travelling direction of the sheet for all stacked cut sheets of varying sizes, whereby the cut sheets can be fed without failure and with sufficient conveying force.

Figure 14A:
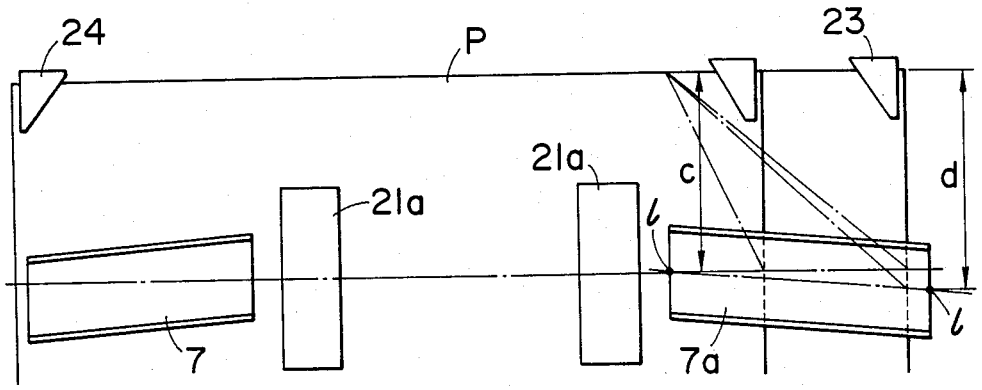
FIG. 14A is a plan view of still another embodiment of the feeding device according to the present invention.
Figure 14B:
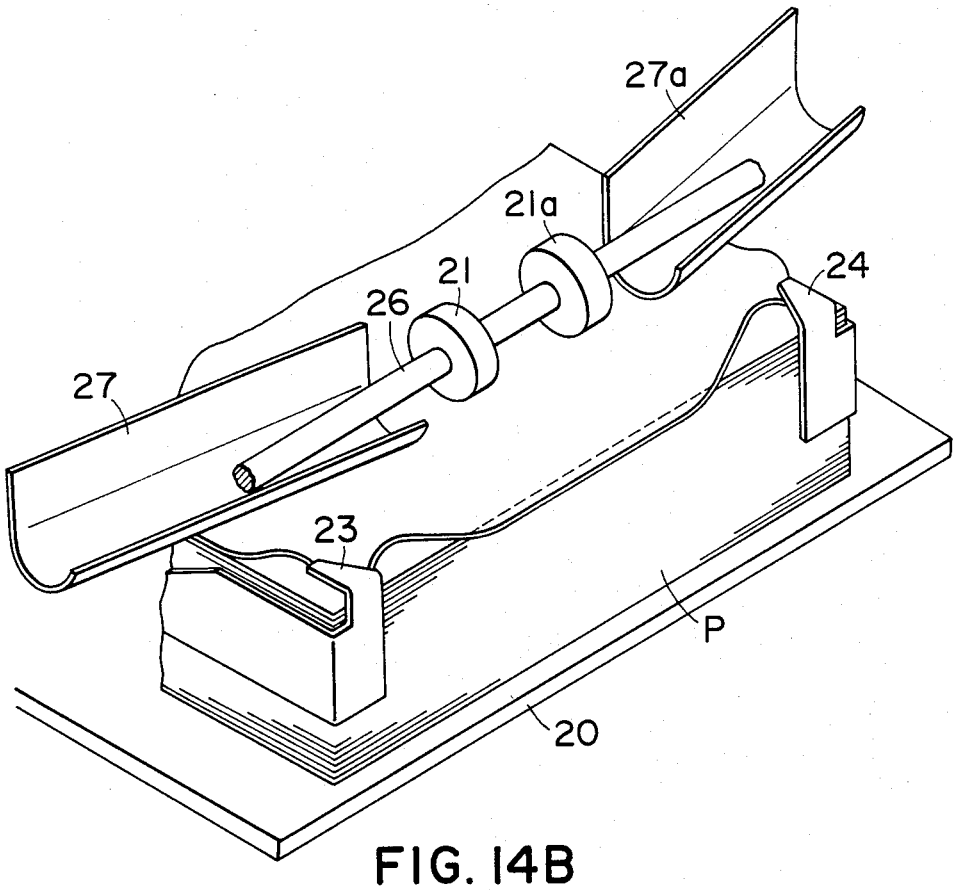
FIG. 14B is a perspective view of the feeding device shown in FIG. 14A at its feeding operation.

Referring now to FIGS. 14A and 14B, a further embodiment of the present invention will be explained hereinbelow.

The feeding device in this embodiment is so constructed that the warp regulating plates are slanted so as to be gradually inclined away from the forward end of the stacked cut sheets in its feeding direction as they extend from the neighborhood of the feed rollers 21, 21*a* toward the lateral side edge of the sheet.

In the drawing, reference numerals 27, 27*a* designate warp regulating plates for the sheets. The warp regulating plates are provided at the main body side of the reproduction apparatus. The surface thereof facing the upper surface side $P_1$ of the cut sheet is arcuate, and kept in a non-contact state to the upper surface $P_1$ of the sheet. Further, the warp regulating plates 27, 27*a* are disposed at their predetermined positions away from the separation pawls 23, 24, and extend in the breadthwise direction of the cut sheet from the neighborhood of the feed rollers 21, 21*a* and in parallel with the roller shaft 26. In addition, the warp regulating plates 27, 27*a* are disposed obliquely with respect to the sheet feeding direction so as to be gradually inclined away from the forward end of the stacked cut sheets in their feeding direction, as they extend in the breadthwise direction of the sheet from the vicinity of the feed rollers 21, 21*a*. In other words, the warp regulating plates 27, 27*a* are so disposed that they may satisfy a relationship of $c<d$ where: c is a distance from the forward end of the cut sheet to the portion of the warp regulating plates 27, 27*a* facing the upper surface of the sheet at the side thereof near the feed rollers, and d is a distance at the side thereof away from the feed rollers. Even in this embodiment, the same effect as mentioned above can be obtained, whereby more accurate sheet feeding performance can be attained.

Incidentally, in each of the embodiments shown in FIGS. 12A, 12B and FIGS. 14A, 14B, the portion of the warp regulating plates adjacent to the surface of the stacked cut sheet is not limited to the arcuate shape, but it may be in a planar shape. Accordingly, the ridge l—l is not limited to a line, but it may constitute a rectangular plane to attain the same result. Further, the forward end side of the warp regulating member in the sheet feeding direction may be extended beyond the outer periphery of the feeding rollers. Furthermore, a more remarkable effect can be obtained by constructing the warp regulating plates in a manner to maintain the distance between the plates and the upper surface of the stacked cut sheets as well as the distance between the plates and the forward end of the sheet in its feeding direction as mentioned in the foregoing, i.e., by combined use of the abovementioned embodiments. According to the experiments done by the present inventors, the distance between the warp regulating plates and the separation pawls in the sheet feeding direction should most desirably be from 20 to 40 mm, and a space interval between the warp regulating plates and the upper surface of the stacked cut sheets should most desirably be from 1 to 10 mm.

Figure 15A:
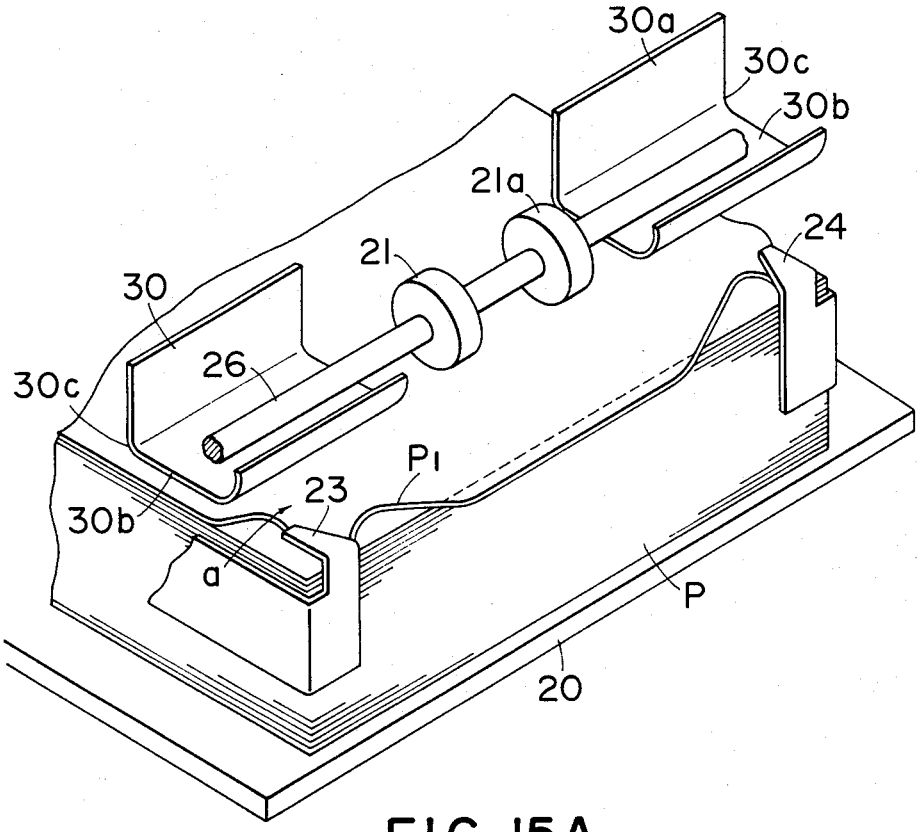
FIG. 15A is a perspective view of a further embodiment of the feeding device according to the present invention.
Figure 15B:
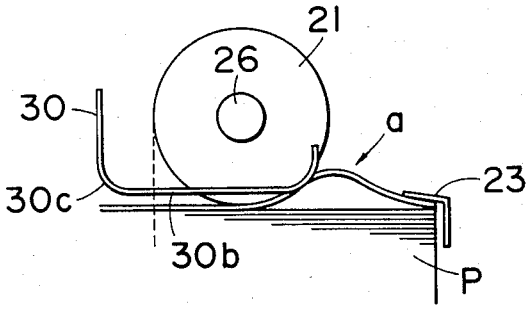
FIG. 15B is a side elevational view of the feeding device shown in FIG. 15A.

In the following, a still further embodiment of the feeding device according to the present invention will be explained in reference to FIGS. 15A and 15B, wherein the rear end of the warp regulating plates characteristically extends in the non-feeding direction beyond the outer periphery of the sheet feeding rollers.

Referring to the drawing, reference numerals 30, 30*a* designate the warp regulating plates for the stacked cut sheets. The warp regulating plates are provided at the main body side of the reproduction apparatus in a non-contact state with the upper surface of the topmost sheet. These warp regulating plates 30, 30*a* extend in the axial direction in parallel with the roller shaft 26, and the portion of the plates adjacent to the upper surface of the stacked cut sheet assumes a substantially planar shape 30*b*. Further, the rear end 30*c* of the warp regulating plates protrudes in the non-sheet feeding direction beyond the outer periphery of the feed rollers 21, 21*a*. On account of this, the cut sheet $P_1$ sent out by rotation of the feed rollers 21, 21*a* is temporarily hindered in its forward movement by the separation pawls 23, 24 oscillatably provided near the forward end corners in the feeding direction of the stacked sheets, and forms warping a between the separation pawls 23, 24 and the feed rollers 21, 21*a*. At this instant, according to this embodiment, since the rear end 30*c* of the warp regulating plates 30, 30*a* protrude in the non-sheet feeding direction beyond the outer periphery of the sheet feeding rollers 21, 21*a*, the warping to be formed at the non-feeding side due to low tenacity of the sheet, or depending on various conditions such as feeding speed, circumstances surrounding the device, and so on, is suppressed to the minimum extent, whereby only the warping a at the feeding side (i.e., between the separation pawls and the feed rollers) becomes gradually large. When the warping a attains a predetermined size, it contacts the planar part 30*b* of the warp regulating plates 30, 30*a* adjacent to the stacked cut sheets to be suppressed its growth, hence the warping, will not become too large in size, and formed in the vicinity of the separation pawls 23, 24 in its optimum size. Then, the stacked cut sheet $P_1$ is released from the separation pawls without failure due to force from the warping and tenacity of the sheet itself, whereby it is separated from the remaining cut sheets in stack, and fed into the reproduction machine.

Therefore, according to this embodiment, the feeding force from the feed rollers 21, 21*a* is accurately transmitted to both front end parts of the cut sheet to be fed, irrespective of the size or tenacity of the cut sheet, or irrespective of changes in the feeding conditions such as feeding speed, circumstantial conditions, etc. On account of this, appropriate warping a is formed in the vicinity of the separation pawls 23, 24, and the sheet is accurately released from the separation pawls 23, 24 by the restoring force due to tenacity of the sheet itself, after which it is fed into the reproduction apparatus. After all, occurrences of undesirable phenomenon such as jamming at the sheet feeding port, oblique movement of the sheet, wrinkling in the sheet, etc. can be further reduced, and stable sheet feeding performance can be attained.

In this embodiment, the portion of the warp regulating plates adjacent to the upper surface of the stacked cut sheets has been exemplified as being planar. However, the present invention is not limited to this example, but it may take other shape such as, for example, arcuate form. Also, the warp regulating plates are not required to be disposed substantially parallelly to the stacked cut sheets, provided that the rear end thereof protrudes in the non-feeding direction beyond the outer periphery of the feeding means. For example, the warp regulating plates may be provided in a gradually elevated slope as they direct toward the sheet feeding direction. According to the experiments done by the present inventor, the distance between the warp regulating plates and the separation pawls in the sheet feeding direction should desirably be from 20 to 40 mm, and the space interval between the warp regulating plates and the upper surface of the sheet should desirably be from 1 to 10 mm, or so. According to this embodiment, it is possible to feed the stacked cut sheets with more accurate separation performance as well as with stable feeding performance even with a cut sheet having low tenacity, or irrespective of changes in various feeding conditions such as feeding speed, circumstantial conditions, and so forth.

In the above-described various embodiments, the warp regulating plates may not necessarily be provided in a continuous form, but they may be provided intermittently or in a comb shape. Further, the warp regulating plates is not limited to be provided on the main body of the image forming apparatus such as reproduction apparatus, but they may be disposed on the stacking table, for example. The type of the stacking table includes those of a fixed type on the main body of the image forming device, or of a drawer type, or of so-called cassette type, in which the cut sheets are accommodated in stack and which can be loaded in a mountable and dismountable manner on the main body of the image forming device. In other words, the warp regulating plates may be mounted on the fixed members such as the stacking table, the cassette, or the main body of the image forming apparatus. Furthermore, the warp regulating plates may be made of any kind of material such as spring material, ferrous material, plastics, and so forth. It is to be noted that, if the surface of the plates facing the topmost cut sheet in the stack is smooth, more favorable separation and feeding performances can be exhibited.

As stated in the foregoing, by use of the feeding device according to the present invention, more stable separation and feeding performances of the stacked cut sheets can be attained.

What we claim is:

1. A feeding device, comprising:

a stacking table for carrying thereon a stack of cut sheets;

separation pawls, disposed on the downstream side of said stacking table with respect to a feeding direction of the cut sheets to engage both downstream corners of said stack of cut sheets, for separating the topmost sheet of the stack;

first mounting means;

feeding means, mounted with said first mounting means to be disposed upstream of said separation pawls with respect to the feeding direction of the cut sheets, for urging the topmost sheet in the feeding direction to cooperate with said separation pawls to warp the topmost sheet and separate it from the remaining sheets of the stack, and then feed it out;

second mounting means separate from said first mounting means; and warp regulating means, mounted with said second mounting means to provide a clearance between itself and the topmost sheet when the topmost sheet is not fed, for regulating the formation of the warp, at least a portion of said warp regulating means being disposed between said feeding means and said separation pawls in a direction generally perpendicular to the feeding direction and downstream, in the feeding direction, of a portion of contact between the feeding means and the cut sheets and between the portion of contact and said separation pawls.

2. Feeding device as set forth in claim 1, wherein said warp regulating means has a forward end which is provided in contiguity to the sheets as stacked.

3. Feeding device as set forth in claim 1, wherein said warp regulating means is provided in a adapted to move condition.

4. Feeding device as set forth in claim 1, wherein said warp regulating means has a forward end which protrudes beyond the outer periphery of said feeding means.

5. Feeding device as set forth in claim 1, wherein said warp regulating means extends in the direction perpendicular to the feeding direction.

6. Feeding device as set forth in claim 1, wherein said second mounting means is the stacking table.

7. The feeding device as set forth in claim 1, wherein said second mounting means is the main body of an image forming apparatus.

8. A feeding device, comprising:

a stacking table for carrying thereon a stack of cut sheets;

separation pawls, disposed on the downstream side of said stacking table with respect to a feeding direction of the cut sheets to contact both downstream corners of said stack of cut sheets, for separating the topmost sheet of the stack;

first mounting means;

feeding means, mounted with said first mounting means to be disposed upstream of said separation pawls with respect to the feeding direction of the cut sheets, for urging the topmost sheet in the feeding direction to cooperate with said separation pawls to warp the topmost sheet and separate it from the remaining sheets of the stack, and then feed it out;

second mounting means separate from said first mounting means; and warp regulating means, mounted with said second mounting means to provide a clearance between itself and the topmost sheet, at least a portion of said warp regulating means being disposed between said feeding means and said separation pawls in a direction generally perpendicular to the feeding direction for contacting the topmost sheet when it is warped to regulate the formation of the warp, the clearance being larger at the edge portions of the topmost sheet than at the center portion of the topmost sheet.

9. A feeding device, comprising:

a stacking table for carrying thereon a stack of cut sheets;

separation pawls disposed to engage both downstream corners of the cut sheets, for separating the topmost sheet of the cut sheets stacked on the stacking table;

first mounting means;

feeding means, mounted with said first mounting means to be disposed upstream of said separation pawls with respect to the feeding direction of the cut sheets, for urging the topmost sheet of the cut sheets stacked on the stacking table in the feeding direction to cooperate with said separation pawls to warp the topmost sheet and separate it from the remaining sheets of the stack and then feed it out;

second mounting means separate from said first mounting means; and warp regulating means mounted with said second mounting means for regulating the warp of the cut sheet when it has been formed by the cooperation of the feeding means and the separation pawls, at least a portion of said warp regulating means being disposed between the feeding means and the separation pawls in the direction of the width of the cut sheets generally perpendicular to the feeding direction.

10. A feeding devive according to claim 1, 8 or 9, wherein said feeding means comprises feed rollers.

11. A feeding device according to claim 1, 8 or 9, wherein said feeding means comprises a feed roller shaft.

12. A feed device as set forth in claim 9, wherein the distance between a portion of said warp regulating means contacting the topmost sheet and the forward end of said sheet in the feeding direction is relatively larger at the side away from the feeding means than at the side near said feeding means.

13. Feeding device as set forth in claim 12, wherein a portion of said warp regulating means which contacts the cut sheet is substantially arcuate.

14. Feeding device as set forth in claim 12, wherein said warp regulating means extends in the breadthwise direction of the sheet in relation to the feeding direction thereof.

15. A feed device as set forth in claim 9, wherein the rear end of said warp regulating means protrudes in the non-feeding direction beyond the outer periphery of said feeding means.

16. Feeding device as set forth in claim 15, wherein said warp regulating member is provided extendingly in the breadthwise direction of the sheet in relation to the feeding direction thereof.

17. Feeding device as set forth in claim 15, wherein a portion of said warp regulating means adjacent to said sheet constitutes a plane substantially parallel to said stacking cut sheets.

* * * * *